United States Patent [19]

Miyahara

[11] 3,960,396

[45] June 1, 1976

[54] HANDLE FOR OPENING AND CLOSING A DOOR

[75] Inventor: Kingo Miyahara, Tokyo, Japan

[73] Assignee: Dowa Co., Ltd., Tokyo, Japan

[22] Filed: Sept. 11, 1974

[21] Appl. No.: 504,978

[30] Foreign Application Priority Data

June 17, 1974 Japan ..... 49-70584[U]

[52] U.S. Cl. ..... 292/347; 292/DIG. 2; 16/121

[51] Int. Cl.[2] ..... E05C 21/00

[58] Field of Search ..... 16/110 R, 111, 114 R, 16/117, 118, 121; 292/DIG. 2, 336.3, 347, 262; 150/52 L; 70/455

[56] References Cited

UNITED STATES PATENTS

| | | | |
|---|---|---|---|
| 629,999 | 8/1899 | Jacobs | 150/52 L |
| 1,271,331 | 7/1918 | Lewis | 16/121 |
| 1,710,619 | 4/1929 | Haslinger | 150/52 L |
| 2,086,974 | 7/1937 | Belfore | 16/110 R |
| 2,617,290 | 11/1952 | Schwartz | 70/455 X |
| 2,801,122 | 7/1957 | Sutter | 292/DIG. 2 |
| 3,698,754 | 10/1972 | Means | 292/262 |
| 3,827,739 | 8/1974 | Overholser | 292/DIG. 2 |

FOREIGN PATENTS OR APPLICATIONS

| | | | |
|---|---|---|---|
| 604,337 | 7/1948 | United Kingdom | 16/121 |

*Primary Examiner*—George H. Krizmanich
*Attorney, Agent, or Firm*—Hill, Gross, Simpson, Van Santen, Steadman, Chiara & Simpson

[57] ABSTRACT

A handle comprising a main body, a mounting seat formed integrally with the main body and disposed on the top thereof, and an adhesive tape coated with a bonding agent on both the upper surface and the underside. The mounting seat is soft and has a concave surface, so that the handle can be readily and positively affixed to the outer periphery of an existing doorknob by forcing the mounting seat thereagainst and clamping the same thereto after the adhesive tape is adhesively attached to the concave surface the mounting seat. The main body is flat in shape and has a rear edge which is inclined such that the main body is spaced apart a greater distance from the door in going downwardly from the top. A protuberance may be formed at the lowermost end of the inclined rear edge of the main body to form a finger holder.

3 Claims, 6 Drawing Figures

HANDLE FOR OPENING AND CLOSING A DOOR

This invention relates to a novel, useful and improved handle for opening and closing a door.

Heretofore, there have been available two types of door-knobs or door-handles for opening and closing doors. In one type, the door-handles are in the form of a bent lever; and in the other type, they are cylindrical or spherical in shape. The door-handles of the former type each consist of a lever bent as a whole toward the door, so that they are easy to operate. However, the door-handles of this type have a disadvantage in that passers-by may have their clothes inadvertently caught by the bent portion of the lever and torn thereby. The door-handles of the latter type are free from such disadvantage, but some other disadvantages are associated with them. Since the door-handles of this type are cylindrical or spherical in shape, the hand of the operator holding the door-handle tends to slip when the operator tries to turn the door-handle either to left or right, unless the door-handle is gripped firmly. Thus, difficulty is experienced in opening and closing the doors equipped with the door-handles of this type. Besides, the roundness of the door-handle makes it difficult for the operator to decide how far the door-handle should be turned in operation. The door opening and closing device might be damaged by the operator pushing the door hard without turning the door-handle properly. It is almost impossible to open doors equipped with the handles of this type if the operator is loaded with baggage or if the operator is a child.

To eliminate these disadvantages, proposals have in recent years been made to use a door-handle cover made of a cloth of a resilient material and applied to the outer periphery of the door-handle of the cylindrical or spherical shape. This system has achieved some effect, but it also has a disadvantage. The cover made of a cloth and merely applied to the door-handle which is operated many times is readily broken or soiled and has to be replaced by a new one.

Accordingly, a principal object of the invention is to provide a handle for opening and closing a door which can readily be attached to the outer periphery of an existing door-knob and which has the effect of facilitating the opening and closing of the door.

Another object of the invention is to provide a handle for opening and closing a door which is made of a resilient material, a synthetic resinous material or some other suitable material and which can be readily affixed to the outer periphery of an existing door-knob to enable the opening and closing of the door to be effected readily and positively.

Another object of the invention is to provide a handle for opening and closing a door in which a mounting seat formed integrally with a main body of the handle and disposed on the top of the main body is soft, so that the handle can be attached to an existing door-knob by making the mounting seat to conform to the curved outer periphery of the door-knob and the handle can remain in position without being dislodged from the door-knob even if it is operated many times.

Still another object of the invention is to provide a handle for opening and closing a door in which the mounting seat of the handle is formed on its inner periphery with a concave surface, and in which an adhesive tape coated with a bonding agent on both the upper surface and the underside is interposed between the concave surface of the mounting seat and the outer periphery of the existing door-knob when the mounting seat is attached to the outer periphery of the door-knob, whereby the mounting seat can be positively affixed to the outer periphery of the door-knob.

Still another object of the invention is to provide a handle for opening and closing a door of the type described in which the main body of the handle formed integrally with the mounting seat has an inclined rear edge which is spaced apart a greater distance from the door in going downwardly from the top of the main body so as to prevent the clothes of the operator or the like being caught and torn by the main body when the door is opened or closed.

A further object of the invention is to provide a handle for opening and closing a door of the type described in which a protuberance is formed at the lowermost end of the inclined rear edge of the main body of the handle so as to provide therein a finger handle for holding the finger applied thereto. By this arrangement, it is possible to open or close the door quickly merely by applying the finger to the finger holder and pushing the handle to turn the same either to the right or left without requiring to grip the main body of the handle as a whole by the hand.

Additional and other objects and features of the invention will become evident from the description set forth hereinafter when considered in conjunction with the accompanying drawings, in which.

In the drawings, like reference characters designates similar parts in FIG. 1 to FIG. 6.

Figure 1:
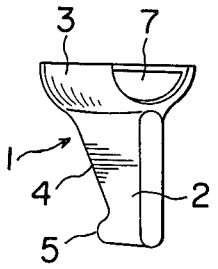
FIG. 1 is a perspective view of one embodiment of the handle for opening and closing a door according to the invention.
Figure 2:
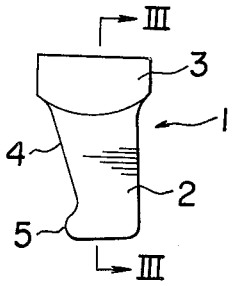
FIG. 2 is a side view of the handle shown in FIG. 1.
Figure 3:
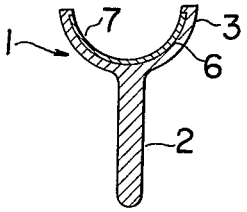
FIG. 3 is a vertical sectional front view on the line III—III of FIG. 2.
Figure 4:
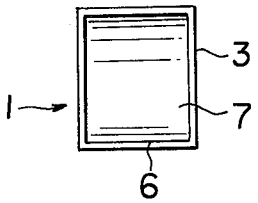
FIG. 4 is a top plan view of the handle shown in FIG. 1.

The numeral 1 generally designates a handle for opening and closing a door according to the invention which is made of a resilient material, a synthetic resinous material or some other suitable material. The handle 1 comprises a main body which is flat in shape so as to enable the finger tip to be positively applied thereto, and a mounting seat 3 disposed on the top of the main body 2 and formed integrally therewith. The mounting seat 3 is soft and can be brought into intimate contact with the outer periphery of a door-knob 9 affixed to a door 8.

The main body 2 of the handle has a rear edge which is inclined as shown at 4, so that the main body 2 is spaced apart a greater distance from the door 8 in going downwardly from the top of the main body 2. The main body 2 is formed at the lowermost end of its inclined rear edge with a protuberance 5 to which a finger is held for holding the finger applied thereto, so as to facilitate turning of the main body 2.

The soft mounting seat 3 is formed on its inner periphery with a concave surface 6 on which is disposed an adhesive tape 7 coated with a bonding agent on both the upper surface and the underside. The adhesive tape 7 has only to be placed on the concave surface 6 when the handle 1 is affixed to the door-knob 9, and the handle 1 and adhesive tape 7 may be stored separately when not in service. 10 is a bolt which can be moved into or out of the door 8 when the door-knob 9 is turned to right or left.

Figure 6:
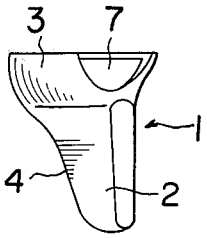
FIG. 6 is a perspective view of another embodiment of the handle according to the invention which has no finger holder formed therein.

In the embodiment shown and described, the protuberance 5 is provided by forming a protuberance at the lowermost end of the rear edge of the main body 2. FIG. 6 shows another embodiment in which the rear edge of the main body 2 is inclined so that the main body is spaced apart a greater distance from the door 8 in going downwardly from the top, but no protuberance is formed to provide a finger holder. This embodiment is as effective as the first embodiment in opening and closing the door.

Figure 5:
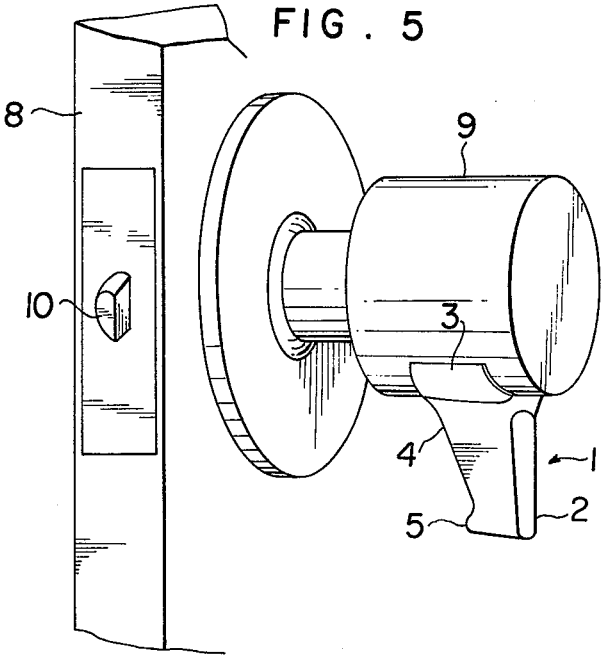
FIG. 5 is a view of the handle according to the invention attached to an existing door-knob and shown in explanation of its operation.

When it is desired to attach the handle 1 shown in FIG. 1 to the outer periphery of the door-knob 9 to facilitate the opening and closing of the door, the adhesive tape 7 having a coating of bonding agent on each surface is adhesively attached to the concave surface 6 of the mounting seat 3, and then the mounting seat 3 is affixed to the door-knob 9 by adhesively attaching the mounting seat 3 to the outer periphery of the door-knob 9 through the adhesive tape 7. If the mounting seat 3 is forced against the outer periphery of the door-knob 9, the mounting seat 3 which is soft can be clamped, as shown in FIG. 5, to the outer periphery of the door-knob 9 through the adhesive tape 7 and will never be dislodged therefrom.

It will be appreciated that the handle according to the invention can be readily attached to the existing door-knob 9 by any member of a household because the work requires no skill. After the handle 1 is affixed to the door-knob 9, it is possible to turn the door-knob 9 lightly either to the left or right if the door-knob 9 is turned in either direction by laying the hand on the door-knob 9 in such a manner that one of the fingers is applied to the protuberance 5. Thus, the door 8 can be opened and closed readily and positively because the finger applied to the protuberance 5 never slips out of position.

The handle according to the invention enables any person to open or close the door by turning the door-knob 9, even if the person trying to open or close the door is loaded with baggage or a child.

To sum up, the main body of the handle according to the invention which is made of a resilient material, a synthetic resinous material or some other suitable material can be positively and firmly attached by any person to the outer periphery of the door-knob 9 in a suitable position through the agency of the adhesive tape 7 adhesively attached to the concave inner surface 6 of the mounting seat 3 which is soft. The use of the handle according to the invention eliminates the need to firmly grip and turn, as has hitherto been the case, the door-knob 9 which is cylindrical or spherical in shape, because the handle according to the invention enables the door 8 to be opened or closed by merely turning the door-knob 9 in either direction by laying the hand on the door-knob 9 in such a manner that one of the fingers is applied the protuberance 5. Thus, when a person is in a hurry or loaded with baggage, the door can readily be opened or closed by applying the finger to the main body 2 of the handle 1 and moving the same leftwardly or rightwardly so as to thereby turn the door-knob 9. Besides, since the rear edge of the main body 1 is inclined, as shown as 4, in such a manner that the main body 1 is spaced apart a greater distance from the door 8 in going downwardly from the top, accidents to the clothes of the person trying to open or close the door by being caught and torn by the handle can be prevented.

I claim:

1. A handle to be attached to a door-knob for opening and closing a door, comprising a planar main body portion which is flat in shape and extending outwardly therefrom so as to enable a finger tip to be positively applied thereto, a semicylindrical mounting seat having inner and outer surfaces extending medially and centrally relative to the outer surface of said main body portion and integral therewith so that the main body portion is attached to the outer surface of said mounting seat and extends from the middle of the mounting seat in a direction substantially normal to the axis of the mounting seat, said mounting seat being flexible so as to enable the mounting seat to be brought into intimate contact with the outer periphery of door-knobs having different sizes and shapes, and double-faced adhesive tape attached to the concave inner surface of said mounting seat for attaching said handle to the door-knob.

2. A handle as claimed in claim 1, wherein said main body portion has one edge inclined in such a manner that the width of the main body portion of the handle is reduced toward the free end of said main body portion.

3. A handle as claimed in claim 2, wherein said inclined edge of the main body portion is formed at said free end with a protuberance engageable by a finger of a user.

* * * * *